US008138459B2

(12) United States Patent
Beausse

(10) Patent No.: US 8,138,459 B2
(45) Date of Patent: Mar. 20, 2012

(54) LARGE KITCHEN PROFESSIONAL OVEN WITH IMPROVED LIGHTING

(75) Inventor: Gerard Beausse, Charenton (FR)

(73) Assignee: Premark FEG L.L.C., Wilmington, DE (US)

( * ) Notice: Subject to any disclaimer, the term of this patent is extended or adjusted under 35 U.S.C. 154(b) by 1188 days.

(21) Appl. No.: 11/911,838

(22) PCT Filed: Apr. 18, 2006

(86) PCT No.: PCT/US2006/014883

§ 371 (c)(1),
(2), (4) Date: Oct. 18, 2007

(87) PCT Pub. No.: WO2006/115977

PCT Pub. Date: Nov. 2, 2006

(65) Prior Publication Data

US 2008/0179317 A1 Jul. 31, 2008

(30) Foreign Application Priority Data

Apr. 22, 2005 (FR) ..... 05 04048

(51) Int. Cl.
*H05B 6/76* (2006.01)

(52) U.S. Cl. ..... 219/680; 219/740; 219/739; 126/200

(58) Field of Classification Search ..... 219/680, 219/740, 739, 741–743, 744, 756; 126/190, 126/198, 200; 99/340, 339
See application file for complete search history.

(56) References Cited

U.S. PATENT DOCUMENTS

| | | | | |
|---|---|---|---|---|
| 3,177,334 | A * | 4/1965 | Kinkle | 219/740 |
| 3,731,035 | A * | 5/1973 | Jarvis et al. | 219/740 |
| 2001/0045429 | A1 | 11/2001 | Eke | |
| 2003/0116030 | A1 | 6/2003 | Wang | |
| 2006/0027574 | A1 * | 2/2006 | Cho | 219/758 |

FOREIGN PATENT DOCUMENTS

| | | |
|---|---|---|
| CN | 1162722 | 10/1997 |
| CN | 2522765 | 11/1997 |
| DE | 23-04-035 | 8/1974 |
| DE | 101-33-108 | 1/2003 |
| DE | 10-2005-039140 | 2/2007 |
| DE | 10-2005-039385 | 2/2007 |
| EP | 1-637-058 | 3/2006 |
| EP | 1-815-779 | 8/2007 |
| FR | 2-540-720 | 8/1984 |

OTHER PUBLICATIONS

International Search Report issued regarding International Application No. PCT/US2006/014883 (Aug. 24, 2006).
International Preliminary Report on Patentability issued regarding International Application No. PCT/US2006/014883 (Oct. 23, 2007).

* cited by examiner

*Primary Examiner* — Quang Van
(74) *Attorney, Agent, or Firm* — Thompson Hine LLP

(57) ABSTRACT

A dual-heating oven includes a cavity heated by both microwaves and at least one of convection or steam, a source for lighting the cavity and a door for closing the cavity. The door includes a first internal sealing glazing, a second intermediate internal glazing, a metal screen sandwiched between the first internal sealing glazing and the second intermediate internal glazing and a third external glazing for general protection. The lighting source is mounted on the door substantially in the plane of the second intermediate glazing.

5 Claims, 3 Drawing Sheets

LARGE KITCHEN PROFESSIONAL OVEN WITH IMPROVED LIGHTING

The invention relates to what are called professional "grande cuisine" ovens. This term is applied to ovens having an internal capacity of at least approximately 0.15 $m^3$. Several types of "grande cuisine" ovens exist.

Ovens with convection heating include, inside the oven cavity, a gas burner or one or more heating resistances and one or more convection fans.

Certain ovens with steam heating include a steam generator external to the cavity. These are ovens with indirect steam production.

Other ovens with steam heating include, inside the cavity, at least one fan associated with a heating resistance or a gas burner onto which water is projected to produce steam directly inside the oven.

Combi or combined ovens are known, which have dual heating by convection and by steam, as do, moreover, certain of those mentioned above. Combi ovens have tended to replace the others for some time now.

Lastly, yet another category of professional "grande cuisine" ovens is known, which combines at least one of convection heating and steam heating with microwave heating. These ovens are described in particular in U.S. Pat. No. 6,452,142 of the company Appollo USA, Inc.

The invention of the present application relates more particularly to a professional "grande cuisine" oven with at least combined dual heating by steam or by convection and by microwaves. The door of such an oven includes, from the inside to the outside,

- a first internal sealing glazing,
- a metal screen tight against microwave radiation,
- a second intermediate glazing to sandwich the metal screen between the two glazings and thus hold and protect it and
- a third external glazing for general protection of the operator and forming, with the second intermediate glazing, a space for circulation of air to thus keep this third glazing at a cool ambient temperature.

The ovens are generally equipped with lamps to illuminate the interior. These lamps then being mounted on one of the edges of the frame of the external glazing, the light rays are therefore inclined relative to the perpendicular to the plane of the frame and consequently, when the door is closed, to the plane of the back of the oven.

This does not create problems with an oven without microwave heating. However, with an oven including a metal screen tight against microwave radiation, the light rays, coming from sources relatively distant from this screen, are reflected on the screen to the point that very little light energy reaches the oven cavity.

The invention of the present application is intended to resolve this problem.

Thus it relates to a professional "grande cuisine" oven with at least dual heating by microwaves, on the one hand, and by convection or steam, on the other, comprising a cooking cavity and a door for closing the cavity including a first internal sealing glazing and a second internal intermediate glazing which sandwich a metal screen tight against microwave radiation to hold it and protect it and a third external glazing for general protection, the sources for lighting the cavity being mounted on the door, which oven is characterised by the fact that the lighting sources are mounted substantially in the plane of the second intermediate glazing holding the metal screen.

Thus, the lighting lamps being as close as possible to the reflective screen, not to say against this screen, the light rays are in practice no longer reflected on it and the operator can see properly inside the oven.

In the preferred embodiment of the oven of the invention, the lighting sources are mounted in a row mounted between the frame of the external glazing for general protection and the frame of the assembly of the metal screen and its two holding and protective glazings, on the inner upright of the frame of the external glazing pivoting on the wall of the oven cavity.

The invention will be better understood with the assistance of the following description of the preferred embodiment of the oven of the invention with reference to the attached drawings, in which.

Figure 1:
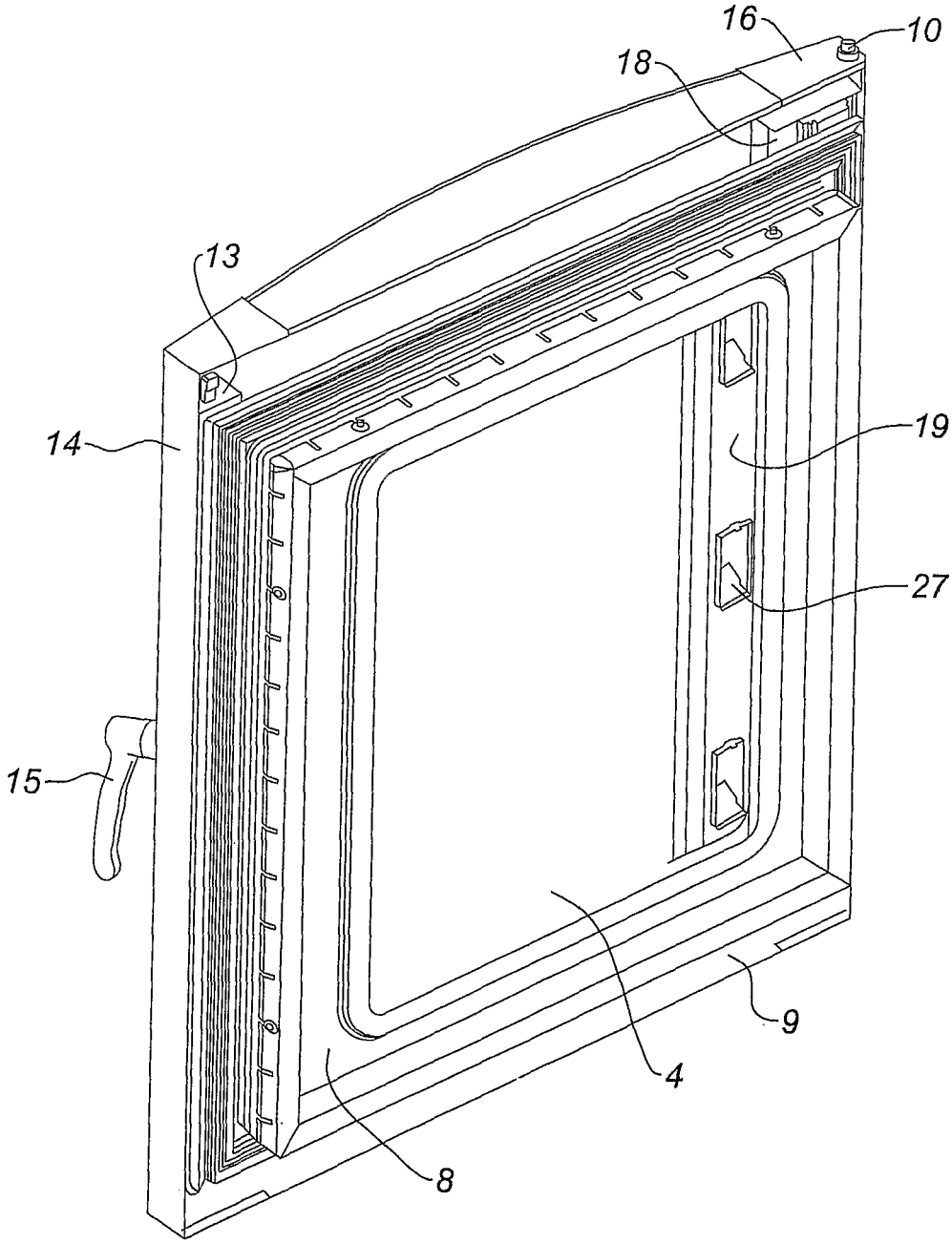
FIG. 1 is a perspective view, seen from the oven cavity side, of its closure door.
Figure 2:
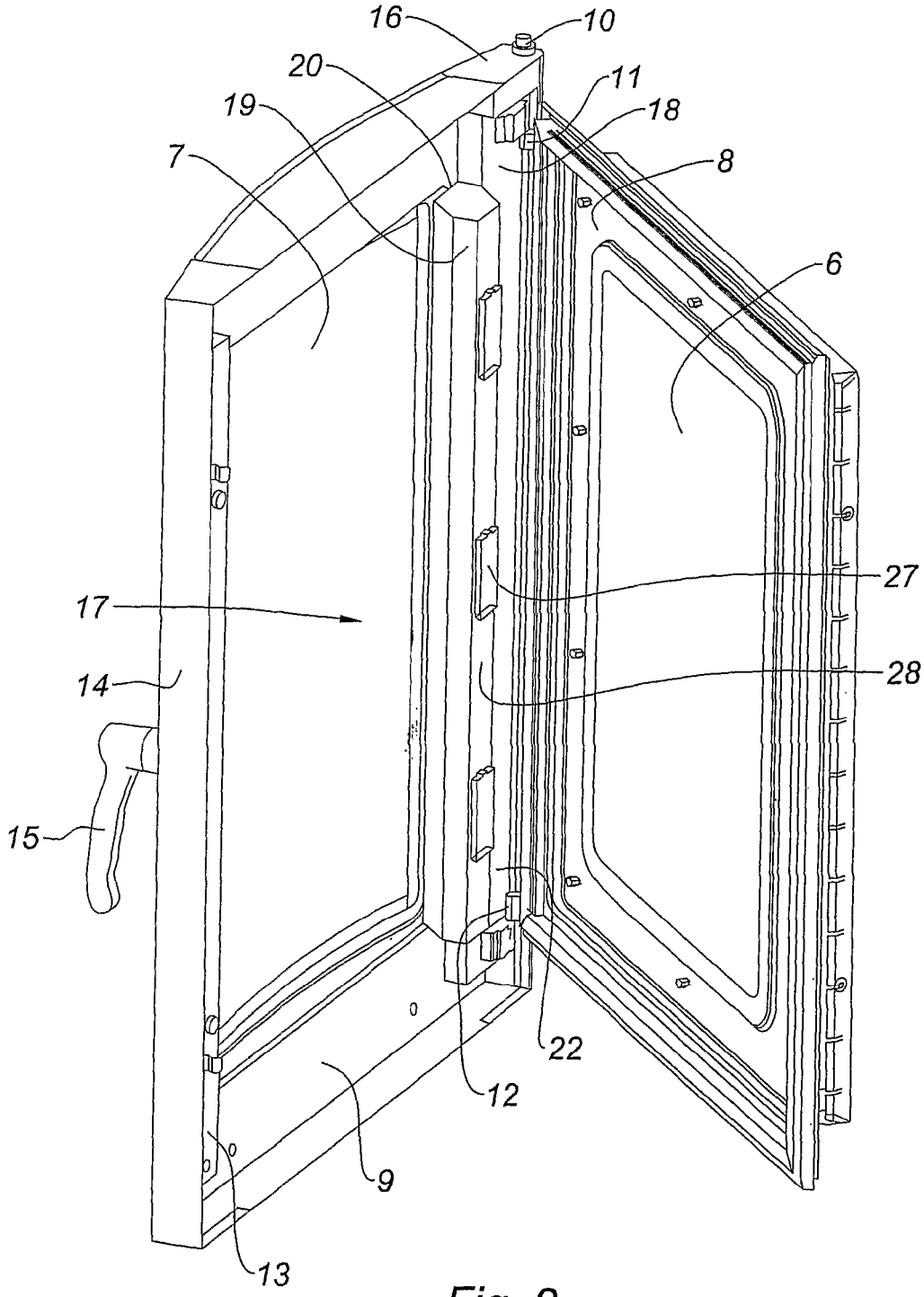
FIG. 2 is a perspective view of the door of FIG. 1, the frame of the metal screen and of its two holding and protective glazings pivoted inwardly relative to the frame of the external glazing for general protection
Figure 3:
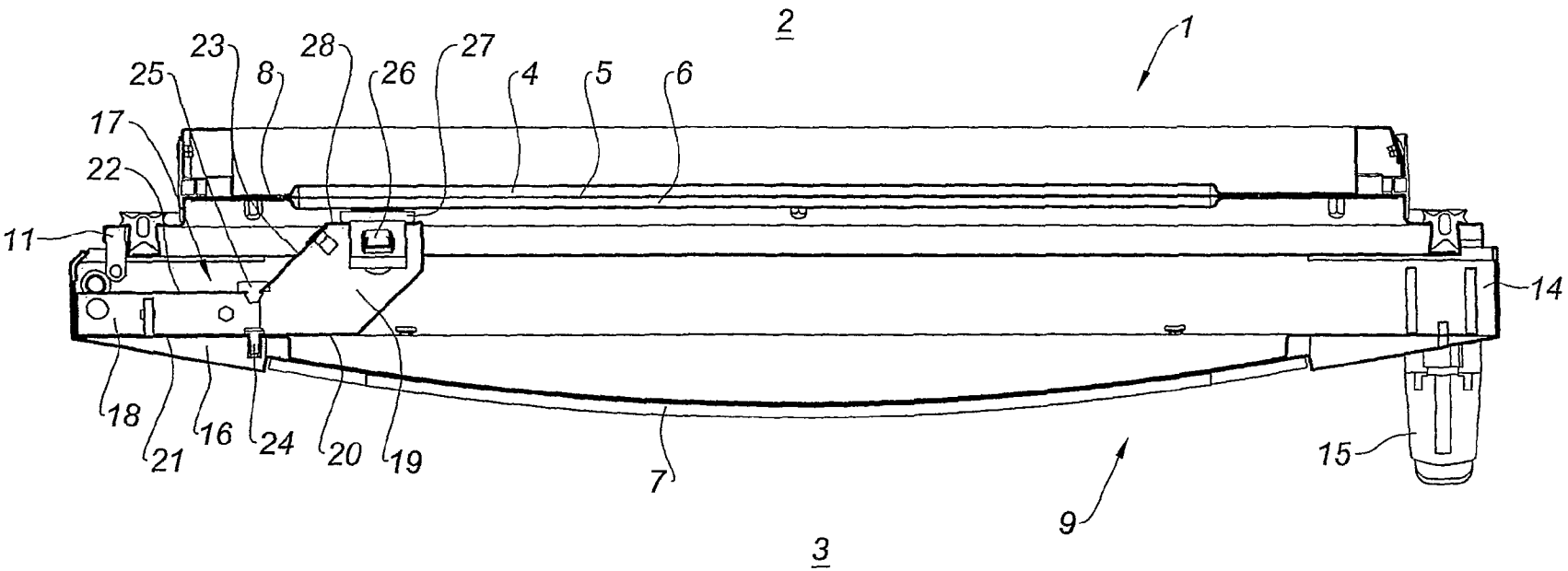
FIG. 3 is a simplified view in section, without shading, of the door of FIG. 1.

The oven door 1 which will now be described includes, from the inside, that is to say from the oven cavity 2 side, to the outside 3

- a first internal glazing 4,
- a metal screen 5,
- a second intermediate glazing 6 and
- a third external glazing 7.

The first two glazings 4, 6 and the metal screen 5 are mounted on an internal frame 8. The third external glazing 7 is mounted on an external frame 9.

The door 1 is intended to be mounted, in the case shown, on the left vertical wall of the oven, looking towards the interior of the oven, by means of hinge shafts 10.

The oven in question is a professional "grande cuisine" oven with microwave heating combined with another conventional heating, by convection and/or by steam.

The hinge shafts 10 are mounted on the inner upright 16 of the external frame 9 of the external glazing 7. The internal frame 8 is mounted on the external frame 9 on which it can pivot by two hinges 11, 12 and be fixed to it by threaded elements (screws, bolts) screwed into a bar 13 attached to the outer upright 14 of the external frame 9. It is to this upright 14 that the handle 15 for manoeuvring the door 1 is fixed.

The first internal glazing 4 is a conventional sealing glazing.

The metal screen 5 is a screen tight against hyperfrequency (microwave) radiation. Here it is an expanded metal grating. Alternatively, a metal mesh could be used.

The second intermediate glazing 6, together with the first internal glazing 4, provides a function of holding and protecting the screen 5 sandwiched between these two glazings.

Lastly, the third external glazing 7 is a general protective glazing which is here outwardly convex. It forms, with the assembly of the screen 5 tight against microwaves and its glazings, a space for circulation of air to keep it at a cool ambient temperature.

Lighting of the oven cavity is effected by a row of lights 17 attached to the internal side of the inner upright 16 of the frame 9. The row of lights 17 includes an upright 18, extending substantially over the whole height of the upright 16 of the door, of rectangular section and extended inwardly and in projection by a box 19 of polygonal section, of lesser height than the upright 18, to correspond substantially to the height of the external glazing 7.

One side 20 of the box 19 extends in the extension of the side 21 of the upright 18 which is fastened against the upright 16 of the frame 9. The side 22 of the upright 18, opposite to the side 21, is extended by the wall 23 of the box 19 which is inwardly inclined to its plane.

The row of lights 17 is fixed to the upright 16 of the frame 9 by screws 24 accessible through orifices formed between the side 22 of the upright 18 and the wall 23 of the box 19, which orifices are normally closed by plugs 25.

The lights 26, here three in number, are housed in the box 19, the light passing through small protective glazings 27 fixed to the wall 28 of the box 19 opposite to the side 20.

When the frame 8 of the metal screen 5 is folded back against the frame 9 of the protective glazing 7, that is to say in the operational position, the row of lights 17 being between the frame 9 of the glazing 7 and the frame 8 of the screen 5, the glazings 27 of the lamps 26 of the lighting box 19 come practically against the intermediate glazing 6. Thus it may be said that the lamps are mounted substantially in the plane of this intermediate glazing 6, due to which, the lamps being as close as possible to the screen 5, the light rays from these lamps are in practice not reflected on the screen 5 and the operator can see properly inside the oven.

The invention claimed is:

1. An oven with at least dual heating by microwaves and by convection or steam, comprising a cooking cavity and a door for closing the cavity including a first internal sealing glazing and a second intermediate internal glazing which sandwich a metal screen tight against microwave radiation to hold it and protect it and a third external glazing for general protection, sources for lighting the cavity being mounted on the door, wherein the lighting sources are mounted substantially in the plane of the second intermediate glazing holding the metal screen.

2. Oven as described in claim 1, in which the lighting sources are mounted in a row mounted between the frame of the external glazing and the frame of the assembly of the metal screen, first internal sealing glazing and second intermediate internal glazing.

3. Oven as described in claim 2, in which the row of lights is mounted on the inner upright of the frame of the external glazing pivoting on the wall of the oven cavity.

4. Oven as described in claim 2, in which the row of lights includes an upright, extending substantially over the whole height of the door and a box extending the upright inwardly and in projection.

5. A dual-heating oven, the oven comprising:

a cavity heated by both microwaves and at least one of convection or steam;

a source for lighting the cavity; and a door for closing the cavity, the door comprising:

a first internal sealing glazing, a second intermediate internal glazing, a metal screen sandwiched between the first internal sealing glazing and the second intermediate internal glazing, and a third external glazing for general protection;

wherein the lighting source is mounted on the door substantially in the plane of the second intermediate glazing.

* * * * *